US005081821A

United States Patent [19]

Meives

[11] Patent Number: 5,081,821

[45] Date of Patent: Jan. 21, 1992

[54] METHOD AND APPARATUS FOR MANIPULATING STACKS OF PAPER SHEETS IN WRAPPING MACHINES

[75] Inventor: Otis Meives, Cleveland, Wis.

[73] Assignee: Pemco Company, Sheboygan, Wis.

[21] Appl. No.: 272,125

[22] Filed: Nov. 16, 1988

[51] Int. Cl.[5] ..... B65B 11/18

[52] U.S. Cl. ..... 53/466; 53/438; 53/529; 53/228; 414/790.7; 271/202; 271/243

[58] Field of Search ..... 53/113, 438, 439, 466, 53/529, 531, 228; 198/434, 456, 459, 461, 626.5, 600, 603, 606; 271/202, 240, 243, 270; 414/788.9, 789.1, 790.7

[56] References Cited

U.S. PATENT DOCUMENTS

| | | | |
|---|---|---|---|
| 1,816,085 | 7/1931 | Langhammer | 53/466 |
| 1,841,714 | 1/1932 | Cone | 198/606 |
| 2,488,551 | 11/1949 | Nordquist et al. | 271/240 |
| 2,536,961 | 1/1951 | Smith | 198/606 X |
| 3,006,119 | 10/1961 | Fingerhut | 53/529 X |
| 3,212,230 | 10/1965 | Coates | 53/466 X |
| 3,776,404 | 12/1973 | Anastasio et al. | 414/790.8 X |
| 3,830,144 | 8/1974 | Kuckhermann et al. | 414/789 |
| 3,964,598 | 6/1976 | Alsop | 198/434 X |
| 4,015,843 | 4/1977 | Tennant | 198/434 |
| 4,381,108 | 4/1983 | Newsome | 271/240 X |
| 4,518,300 | 5/1985 | Kent | 414/790.7 X |
| 4,529,082 | 7/1985 | Mally | 198/434 |
| 4,667,809 | 5/1987 | Raybuck | 271/240 X |
| 4,683,704 | 8/1987 | Vorachek et al. | 53/461 |

*Primary Examiner*—John Sipos
*Attorney, Agent, or Firm*—Peter K. Kontler

[57] ABSTRACT

Stacks of paper sheets are transported from a sheeter into a wrapper by the upper reach of an endless infeed conveyor. The front end faces of successive stacks catch up with and are decelerated by successive flights on an endless second conveyor which is driven at a speed less than the speed of the corresponding section of the infeed conveyor. This ensures that the dimensions of so-called tails, consisting of lowermost sheets of a stack which are shifted rearwardly with reference to the sheets above them, are reduced in size or that the tails are eliminated before the stacks enter the wrapping station. Misoriented stacks are reoriented ahead of the second conveyor by two endless lead-in conveyors having flexible belts trained over vertical pulleys and defining a channel the width of which decreases in the direction of advancement of the stacks. That portion of the path for the stacks where the stacks advance toward and thereupon move with the flights on the second conveyor is flanked by a pair of endless tapes, which are overlapped by the lateral portions of the stacks, and by two sidewalls. The sidewalls are movable toward and away from each other to thus alter the effective width of the path for the stacks. The tapes are movable toward and away from each other at a rate which is less than the rate of movement of the sidewalls.

12 Claims, 3 Drawing Sheets

METHOD AND APPARATUS FOR MANIPULATING STACKS OF PAPER SHEETS IN WRAPPING MACHINES

BACKGROUND OF THE INVENTION

The invention relates to methods of and to apparatus for manipulating stacks of paper sheets or other block-shaped commodities. More particularly, the invention relates to improvements in methods of and in apparatus for manipulating block-shaped commodities in production lines, such as those wherein stacks of paper sheets are draped into blacks of wrapping material prior to introduction into boxes or like receptacles.

Commonly owned U.S. Pat. No. 4,683,704 to Vorachek et al. discloses a method of and an apparatus for manipulating sheets of paper or the like in a sheeter (namely a machine which accumulates sheets of paper or the like into stacks) and in a wrapper which receives stacks from the sheeter. More particularly, the patent to Vorachek et al. discloses a method of and an apparatus for synchronizing the operation of a sheeter with that of a wrapper. Stacks of sheets which are advanced from the sheeter into the wrapper must be transported along an elongated path, and the arrival of stacks into the wrapper must be properly timed to ensure that each stack will reach the wrapping station during a predetermined phase or stage of the respective cycle of the wrapper. This necessitates the provision of a satisfactory infeed apparatus which can control the advancement of successive stacks toward the wrapping station. The stacks are normally advanced by a series of successive endless conveyors each of which comprises several discrete tapes trained over pulleys and being driven to advance the stacks along the elongated path. The transport of stacks often results in at least some shifting of certain sheets relative to the other sheets in a stack so that the stacks can develop so-called tails, namely, groups of lowermost sheets which are shifted relative to the sheets above them. A tail extends from the rear end face of the respective stack, and its sheets are likely to be damaged or defaced during transport toward the wrapping station. Such transport normally involves engagement of the rear end faces of successive stacks by discrete flights of a transfer conveyor which serves to advance successive stacks at predetermined intervals in order to ensure that the stacks will reach the wrapping station during the aforementioned phase or stage of the respective wrapping cycle.

Additional problems arise during transport of stacks whose orientation deviates from an optimum orientation. The misoriented stacks must be reoriented in order to ensure that their front and rear end faces will extend exactly at right angles to the direction of transport not later than when the stacks approach the wrapping station. Presently known orientation changing means include a pair of rollers or drums which are installed at the upstream end of a channel wherein the stacks advance toward the wrapping station while being engaged by the flights of the aforementioned transfer conveyor. A drawback of rollers or drums is that they are likely to lock a stack at the inlet of the channel if the actual orientation of an oncoming stack deviates excessively from the desired or optimum orientation.

The patent to Vorachek et al. discloses an elevator which is provided at the wrapping station to move successive stacks from a first to a second level while the stack is in the process of being draped into a blank of wrapping material. This involves conversion of the blank into a tube which surrounds the stack on the elevator, and closing of the ends of the tube by suitable tucking and folding instrumentalities in order to convert the tube into a prismatic envelope which completely surrounds and confines the respective stack. Problems arise when the stacks are wrapped at a high frequency because the marginal portions of a blank, which are to overlie each other, in order to convert the blank into a tube, are likely to be flexed and/or otherwise deformed by currents of air at the wrapping station.

OBJECTS OF THE INVENTION

An object of the invention is to provide a novel and improved method of feeding stacks of superimposed paper sheets or other block-shaped commodities toward a processing station, particularly toward a station where the commodities are draped into blanks of wrapping paper, foil or the like.

Another object of the invention is to provide a method which renders it possible to eliminate, or at least reduce the dimensions of, so-called tails which develop during transport of stacked paper sheets along a path wherein the stacks are caused to move from at least one preceding conveyor onto a next-following conveyor with resultant shifting of lowermost sheets relative to the sheets in the upper portions of the stacks.

A further object of the invention is to provide a novel and improved method of changing the orientation of stacks in the path along which the stacks are transported toward a wrapping station.

An additional object of the invention is to provide a novel and improved method of controlling the positions of marginal portions of wrappers for stacks of paper sheets or the like at the wrapping station.

Still another object of the invention is to provide a novel and improved apparatus for manipulating block-shaped commodities, particularly stacks of paper sheets or the like, during transport of such commodities from a preceding to a next-following processing station.

A further object of the invention is to provide a novel and improved infeed mechanism which can be used in machines for wrapping stacks of paper sheets or the like.

Another object of the invention is to provide the above outlined apparatus with novel and improved means for eliminating or reducing the dimensions of so-called tails at the rear ends of stacks of paper sheets which are transported from a sheeter to a wrapper.

An additional object of the invention is to provide the apparatus with novel and improved means for changing the orientation of misoriented stacks during transport between the sheeter and the wrapper.

Another object of the invention is to provide novel and improved means for converting blanks of paper or other wrapping material into tubes which surround stacks of paper sheets or other block-shaped commodities.

Another object of the invention is to provide novel and improved means for varying the effective width of the path along which stacks of paper sheets or the like advance between a sheeter and a wrapper.

An additional object of the invention is to provide a wrapper which embodies the above outlined apparatus.

Another object of the invention is to provide a novel and improved production line which embodies the above outlined apparatus.

A further object of the invention is to provide the apparatus with novel and improved means for properly transporting block-shaped commodities at a high frequency so as to meet the requirements of a modern a high-speed processing machine, such as a wrapper for stacks of sheets which consist of paper, foil, cardboard or the like.

Another object of the invention is to provide the apparatus with novel and improved means for moving flights which are used to advance with stacks of paper sheets toward the wrapping station.

An additional object of the invention is to provide the apparatus with novel and improved means for synchronizing the movements of several conveyors which serve to advance block-shaped commodities, to transmit motion to the aforementioned flights, to convert the apparatus for treatment of larger or smaller block-shaped commodities, and to ensure the making of satisfactory envelopes for block-shaped commodities at a frequency at least matching that at which block-shaped commodities are wrapped in heretofore known machines.

SUMMARY OF THE INVENTION

One feature of the present invention resides in the provision of a method of supplying stacks of paper sheets or similar block-shaped commodities to a processing machine, particularly to a wrapping machine wherein the commodities are draped into blanks of paper or the like. The method comprises the steps of transporting a series of spaced-apart flights at a first speed along an endless path a portion of which is located in a predetermined plane (preferably a horizontal plane) and wherein the flights advance in a predetermined direction, and advancing a series of spaced-apart commodities at a higher second speed in the predetermined direction along a second path which leads toward the processing machine and a portion of which coincides with the portion of the endless path so that the front sides or end faces of successive commodities catch up with successive flights and the speed of such commodities is reduced from the second to the first speed.

The method further comprises the steps of disengaging the flights from the respective commodities while the flights and the commodities advance at the same speed, and advancing the commodities along the second path at the first speed.

The method preferably further comprises the step of changing the orientation of commodities upstream of the aforementioned portion of the second path when the orientation of commodities deviates from a predetermined orientation in which the front and rear sides or end faces of the commodities extend at right angles to the predetermined direction.

The method can further comprise the steps of moving successive commodities from a first level to a second level subsequent to disengagement of commodities from the respective flights, and draping blanks of wrapping material around successive commodities during movement between the two levels so that each blank is converted into a portion of a tube while moving with the commodity toward the second level.

Another feature of the invention resides in the provision of an apparatus for supplying stacks of paper sheets or other block-shaped commodities to a processing machine, particularly to a wrapping machine. The apparatus comprises an infeed conveyor having means for advancing a series of spaced-apart commodities in a predetermined direction at a first speed along an elongated first path, a second conveyor defining an endless second path including a first portion which coincides with a predetermined portion of the first path and an ascending second portion which precedes the first portion, a plurality of spaced-apart flights on the second conveyor, and means for driving the second conveyor at a second speed which is less than the first speed so that a commodity which advances along the predetermined portion of the first path catches up and engages a flight in the first portion of the second path and is decelerated by the thus engaged flight. In other words, instead of being capable of catching up with the commodities in front of them, the flights are transported at a speed which is less than the speed of the infeed conveyor so that the commodities can catch up with the flights which are located ahead of them.

The infeed conveyor preferably comprises at least two endless tapes which are disposed in two spaced-apart parallel vertical planes, and each flight preferably includes a portion which is disposed between such planes and extends into the predetermined portion of the first path during movement along the first portion of the second path.

The apparatus can further comprise a third conveyor defining a third path which is substantially aligned with and is located downstream of the first path, and means for driving the third conveyor at a speed which matches or approximates the speed of the flights. This ensures that the flights can be readily separated from the respective commodities by descending below the level of the third path while the commodities advance toward the processing machine.

The apparatus can further comprise two novel lead-in conveyors which flank a second portion of the first path ahead of the predetermined portion (i.e., upstream of the first portion of the second path). Each lead-in conveyor has an endless flexible belt with an elongated reach adjacent the first path. Each such reach includes a front section which extends in the predetermined direction and a rear section which slopes forwardly toward the first path so that the second sections of the two reaches define a tapering channel the width of which decreases in the predetermined direction to thus enable the belts to change the orientation of commodities which lie askew during advancement along the first path. The lead-in conveyors further comprise means for driving the belts at a speed which is higher than the speed of the adjacent section of the infeed conveyor. The belts are trained about pulleys having axes extending at right angles to the direction of advancement of commodities along the first path.

The apparatus preferably further comprises sidewalls which flank at least the predetermined portion of the first path, and means for jointly moving the sidewalls and the respective lead-in conveyors transversely of the first path, i.e., for jointly moving the lead-in conveyors toward or away from each other while the sidewalls move toward or away from each other. Such adjustments of the positions of lead-in conveyors and sidewalls are necessary when the apparatus is to be converted for advancement and proper orientation of larger or smaller commodities.

The apparatus can further comprise outer conveyors which are disposed between the sidewalls and the predetermined portion of the first path to support the adjacent lateral portions of commodities which advance toward the third conveyor. Means is provided for moving the outer conveyors toward or away from each other transversely of the first path to thereby change the loci of the outer conveyors relative to each other, relative to the first path and preferably also relative to the adjacent sidewalls. This can be achieved by coupling the moving means for the outer conveyors with the means for moving the sidewalls in such a way that the extent of movement of the outer conveyors toward or away from each other is less than the extent of movement of the sidewalls toward or away from each other.

A stop gate is preferably installed downstream of the lead-in conveyors, and the apparatus then comprises means for moving the stop gate into and from the first path (i.e., into and from the path for the commodities) at predetermined intervals. Such moving means can comprise means for monitoring the first path and for generating signals in response to detection of irregularities in the manner of advancement of commodities toward the flights, e.g., when two successive commodities abut each other or are too close to one another.

The apparatus or the processing machine can further comprise means for draping successive commodities into blanks of paper or the like, and the third conveyor can be designed to advance successive commodities directly to an elevator of the draping means.

The end portions of the tapes which form part of the infeed conveyor and/or third conveyor are connected to each other by joints which are preferably offset or staggered in the longitudinal direction of the tapes so as to ensure smooth transfer of commodities from the infeed conveyor onto the third conveyor and/or from the third conveyor onto the elevator of the draping means.

An additional feature of the invention resides in the provision of an infeed mechanism for stacks of paper sheets in a machine wherein the stacks are draped into blanks of paper or the like. The improved infeed mechanism comprises an infeed conveyor which defines an elongated path for a series of successive stacks, means for driving the infeed conveyor at a predetermined speed so as to advance the stacks in a predetermined direction along the path, and two lead-in conveyors which flank a portion of the path and each of which comprises an endless flexible belt and pulleys for the belt. Each belt includes a front section which is adjacent the path and extends in the predetermined direction, and a rear section which slopes forwardly toward the path and merges into the respective front section. The pulleys are rotatable about axes which extend at right angles to the path, and the infeed mechanism further comprises means for driving at least one pulley of each lead-in conveyor at a second speed, which preferably exceeds the speed of the adjacent section of the infeed conveyor, and in a direction such that the first sections of the belts advance in the predetermined direction.

Still another feature of the invention resides in the provision of a draping arrangement which can be embodied in a wrapping machine wherein blanks of paper or the like are draped around stacks of superimposed sheets. The improved draping arrangement comprises an elevator which is movable between a lower level and a higher level, conveyor means (such as the aforementioned infeed conveyor or the aforementioned third conveyor) for delivering discrete stacks directly onto the elevator while the elevator is located at the lower level, one or more suction chambers or other suitable means for releasably holding a blank above the stack on the elevator while the elevator is located at the lower level, and means for converting the blank into an envelope which surrounds a substantial part (e.g., nearly four sides) of the stack during movement of the elevator from the lower level to the higher level.

The arrangement preferably further comprises a stop which is located opposite the conveyor means, and at least one loader finger which is operative to move a stack on the elevator against the stop while the elevator is located at the lower level.

The converting means preferably comprises choke bars or other suitable means for flexing the marginal portions of the blank along two end faces of the stack on the elevator during movement of the elevator to the upper level, and two underfolders which have means for folding parts of the flexed marginal portions of the blank beneath the raised stack. At least one of the underfolders can be provided with a so-called vacuum bar to attract the respective marginal portion of the blank.

The stop can be provided with a suction chamber to flex a part of the respective marginal portion of the blank away from the stack during movement of the elevator to the higher level.

Means (e.g., a so-called air bar) can be provided to direct at least one jet of compressed air or another gaseous fluid against the topmost sheet of the stack which is adjacent the elevator while the elevator descends toward the lower level so as to ensure that the topmost sheet or sheets of the stack are not shifted relative to the sheets below by turbulence which is created by the rapidly descending elevator.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1A:
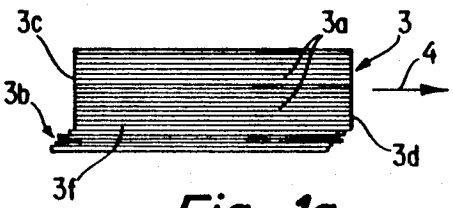
FIG. 1*a* is a side elevational view of a stack of superimposed sheets, further showing a tail the size of which can be reduced or which can be eliminated during transport of the stack in the apparatus of FIG. 1.
Figure 1:
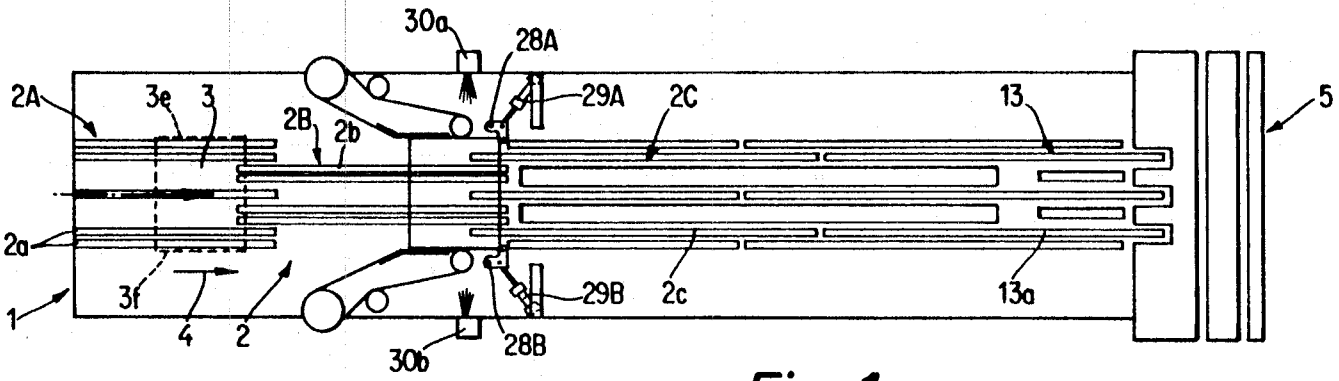
FIG. 1 is a schematic plan view of a portion of a wrapping machine for stacks of superimposed paper sheets, the second conveyor and the flights of the improved infeed apparatus being omitted.

Referring first to FIG. 1, there is shown a portion of a processing machine which includes a frame or support 1 for an apparatus having an infeed conveyor 2 for a series of spaced-apart block-shaped commodities 3. Each such commodity constitutes a stack of superimposed paper sheets 3*a* (FIG. 1*a*) which are advanced in the direction of arrow 4 along an elongated horizontal path A toward an elevator 5 forming part of a wrapping mechanism wherein the commodities (hereinafter called stacks) are draped into blanks 6 (FIG. 6) of paper or other suitable wrapping material.

The infeed conveyor 2 comprises a first section 2A which has five endless flexible tapes or bands 2*a*, a second section 2B which partly overlaps the first section 2A and has four endless tapes or bands 2*b*, and a third section 2C partly overlapping the second section 2B and having three endless tapes or bands 2*c*. The tapes or bands (hereinafter called tapes) of the sections 2A, 2B, 2C are disposed in parallel vertical planes which are spaced apart from each other so that the rearmost portions of the upper reaches or stretches of the tapes 2*b* can extend into the spaces between the front portions of upper reaches or stretches of the tapes 2*a* and the rearmost portions of the upper reaches or stretches of the tapes 2*c* can extend into the spaces between the front portions of upper reaches of the tapes 2*b*. The upper reaches of the tapes 2*b* are coplanar or substantially coplanar with the upper reaches of the tapes 2*a* and 2*c*. As a stack 3 advances from the upper reaches of the tapes 2*a* onto the upper reaches of the tapes 2*b* and thence onto the upper reaches of the tapes 2*c*, it is likely to develop a so-called tail 3*b* (see FIG. 1*a*) which normally consists of a few sheets 3*a* (e.g., up to six sheets). However, tails can also develop during manipulation of stacks ahead of the tapes 2*a*, for example, in a so-called sheeter 15 a part of which is shown in the left-hand portion of FIG. 2.

The sheets 3*a* of the tail 3*b* are offset relative to each other and/or relative to the sheets 3*a* forming the major part of the respective stack 3, and the tail extends rearwardly beyond the rear end face 3*c* of the respective stack. The sheets 3*a* forming the tail 3*b* are the lowermost sheets of the respective stack 3. The front end face 3*d* and the rear end face 3*c* of each stack 3 which is properly oriented on the infeed conveyor 2 extend at right angles to the direction (arrow 4) of advancement of stacks with the tapes 2*a*–2*c*, and each properly oriented stack 3 extends transversely of such direction, i.e., the front and rear end faces 3*d*, 3*c* are longer than the lateral faces 3*e* and 3*f* of the stack.

Figure 3:
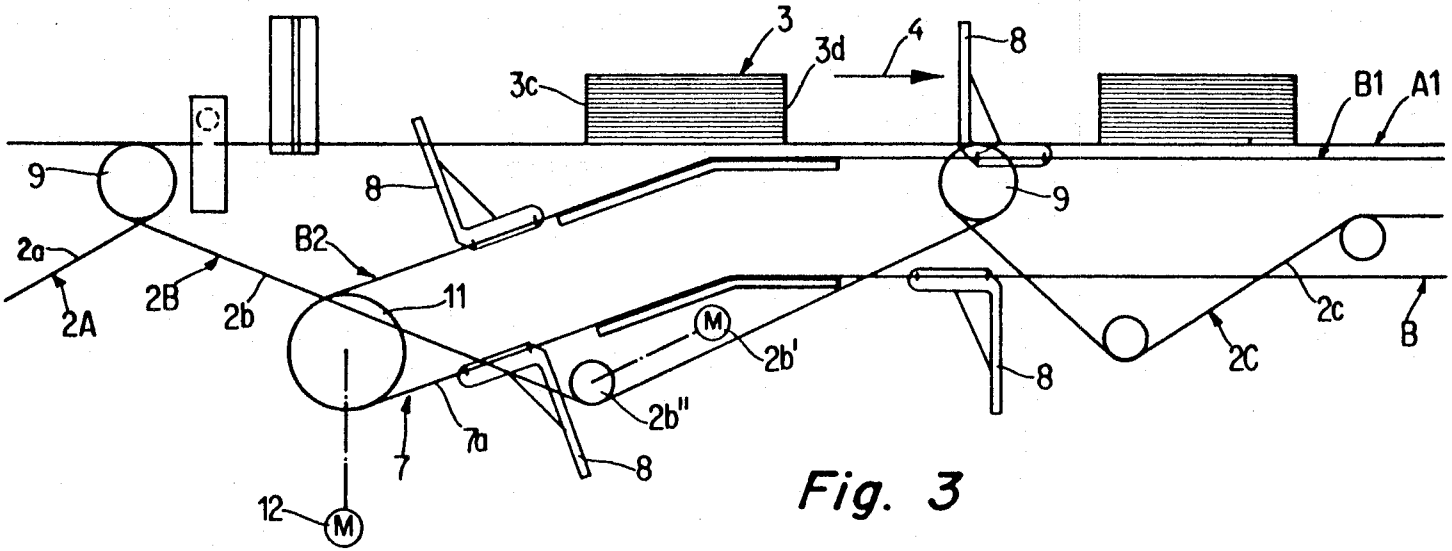
FIG. 3 is an enlarged fragmentary schematic side elevational view of a portion of the apparatus, further showing a portion of the second conveyor and some of its flights.

The apparatus further comprises an endless second conveyor 7 (FIG. 3) which includes two endless tapes or bands 7*a* and carries a set of uniformly spaced-apart flights 8 which cooperate with the tapes 2*c* to eliminate or at least reduce the dimensions of tails 3*b* on stacks 3 in the elongated horizontal path A defined by the infeed conveyor 2. To this end, the pulleys 9 for the tapes 2*c* are driven by at least one first prime mover 10 at a first speed, and at least one pulley 11 for the tapes 7*a* of the second conveyor 7 is driven by a second prime mover 12 at a speed which is less than the first speed. The path A which is defined by the infeed conveyor 2 has an elongated portion A1 substantially coinciding with a first portion B1 of the path B which is defined by the second conveyor 7 for the flights 8, and the path B includes an upwardly sloping second portion B2 which merges into and is located ahead of the portions A1 and B1. As can be seen in FIG. 3, a flight 8 which advances along the path portion B2 toward the path portion B1 gradually enters the path A at, a time when it is spaced apart from the rear end face 3*c* of a stack 3 in the path portion A1 so that it never catches up with such stack. On the contrary, the front end face 3*d* of the stack 3 catches up with and engages the rear side of the preceding flight 8 whereby the tapes 2*c* begin to move relative to the tail 3*b* and cause the sheets 3*a* of the tail to move forwardly (arrow 4) relative to the sheets 3*a* above the tail. This results in complete elimination or, at the very least, in substantial reduction of the tail 3*b* before the conveyor 7 causes the respective flight 8 to gradually descend beneath the path A (during travel around the front pulley 11 (FIG. 4) for the tapes 7*a*). For example, the tapes 2*c* can cover a distance of 22 inches while a flight 8 covers a distance of 18 inches.

Each flight 8 includes two portions or prongs which are disposed in two vertical planes including the spaces between the tapes 2*c* of the infeed conveyor section 2*c*. Thus, the tapes 2*c* move forwardly (arrow 4) at a speed which exceeds the speed of the tapes 7*a* in the path portions B2 and B1 to thus ensure that the stacks 3 move faster than the flights 8 and that the front end faces 3*d* of the stacks actually engage the flights 8 in front of them whereby the stacks 3 are decelerated and the sheets 3*a* of the tails 3*b* move relative to the remaining sheets of such stacks. This is in contrast to the mode of operation of presently known infeed apparatus wherein the flights advance faster than the stacks so that the flights strike upon the tails and deform (dent) or actually tear the lowermost sheets of the stacks without any shifting of sheets which form the tails relative to the major parts of the corresponding stacks. This presents problems during wrapping of the stacks and might even necessitate segregation of the respective stack from other stacks which have less pronounced tails or happen to be without tails.

The infeed conveyor 2 is followed by a third conveyor 13 having three endless tapes or bands 13*a* each of which is coplanar with one of the tapes 2*c*. One of the pulleys 14 for the tapes 13*a* is driven by the prime mover 12 at the speed of the conveyor 7 so that the tendency of lowermost sheets 3*a* of a stack 3 to move forwardly relative to the sheets above them is terminated as soon as the stack advances beyond the upper reaches of the tapes 2*c* and begins to advance with the tapes 13*a*. The tapes 13*a* transport the stacks 3 all the way to the elevator 5 at the wrapping station.

The flights 8 are automatically disengaged from the front end faces 3*c* of the respective stacks 3 when they reach and travel around the right-hand pulley 11 (FIG. 4) for the tapes 7*c*.

Figure 2:
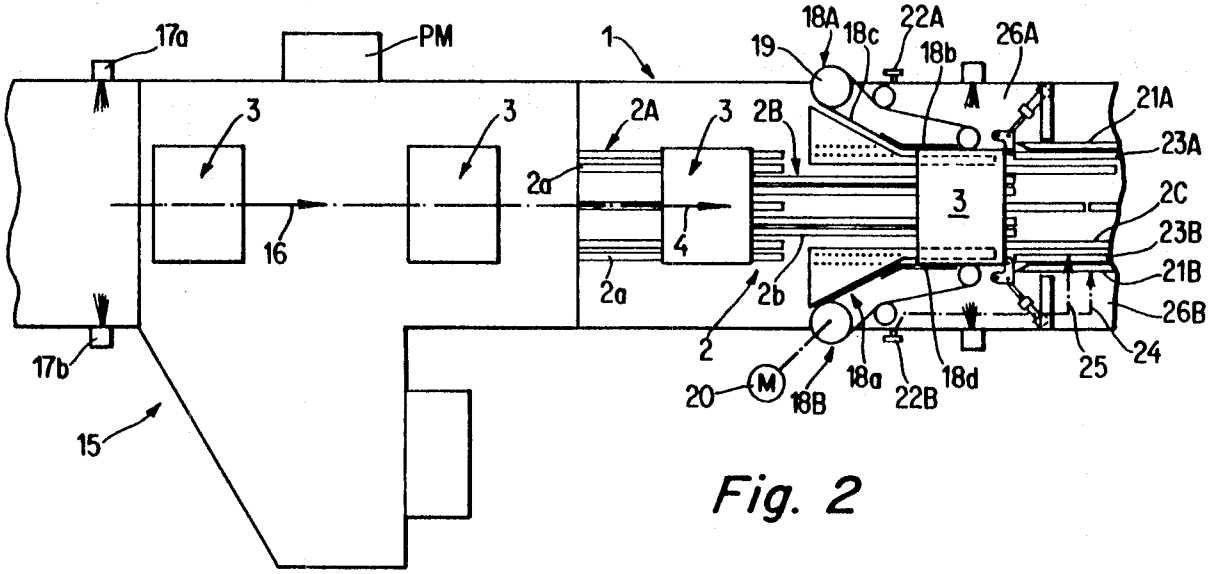
FIG. 2 shows a portion of the structure of FIG. 1 and a portion of a sheeter which supplies stacks to the infeed apparatus.
Figure 4:
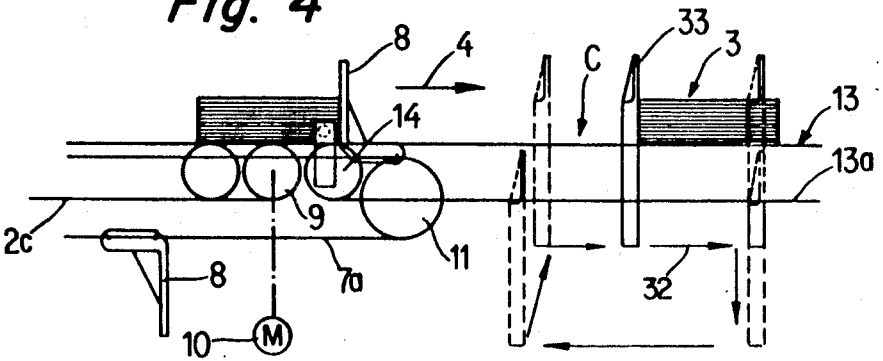
FIG. 4 is an enlarged plan view of a portion of the third conveyor in the apparatus of FIGS. 1 to 3.

FIG. 2 shows the left-hand portion of the apparatus of FIGS. 1, 3 and 4, and a portion of a sheeter 15 which serves to supply stacks 3 to the infeed conveyor 2. A conveyor 16 (indicated by an arrow) serves to advance a series of successive stacks 3 onto the upper reaches of tapes 2*a* forming part of the first section 2A of the infeed conveyor 2. The tapes 2*a* of the conveyor section 2A are driven at the speed of the conveyor 16 and can receive motion from the prime mover PM of the sheeter 16. The speed of the conveyor 16 and conveyor section 2A is variable.

FIG. 2 further shows a photoelectronic detector having a radiation source 17*a* at one side and a transducer 17*b* at the other side of the conveyor 16. The transducer 17*b* transmits phasing signals which are used to regulate the rate of delivery of stacks 3 to the infeed conveyor 2, for example, in a manner as disclosed in the aforementioned U.S. Pat. No. 4,683,704 to Vorachek et al.

That portion of the path A which is located ahead of the path portion Al is flanked by two endless lead-in conveyors 18A, 18B which serve to change the orientation of misoriented stacks 3 on their way toward engagement with the flights 8. Each lead-in conveyor has an endless belt conveyor with a substantially V-shaped inner reach 18*a* backed by a squaring guide 18*d* and including a front section 18*b* which extends in parallelism with the direction (arrow 4) of advancement of stacks 3 along the path A, and a rear section 18*c* which tapers forwardly and inwardly toward the adjacent tape 2*b* and defines with the other section 18*c* a channel of diminishing width wherein a misoriented stack 3 is caused to change its orientation and to be properly oriented (so that its end faces 3*c*, 3*d* are normal to the direction of arrow 4) not later than on leaving the channel between the sections 18*b* of the reaches 18*a*. One of the pulleys 19 for each of the lead-in conveyors is driven by a prime mover 20 at a speed which matches the speed of the tapes 2*a*. The pulleys 19 are rotatable about vertical axes. The lead-in conveyors 18A, 18B are movable relative to the support 1 together with two elongated sidewalls or guide rails 21A, 21B which flank the path portion Al and are movable toward and away from each other transversely of the path portion Al to thereby change the effective width of the path A in the region ahead of the conveyor 13. The means for moving the sidewalls 21A, 21B toward and away from each other comprises two rotary knobs 22A, 22B.

Additional (outer) conveyors 23A, 23B flank the two outer tapes 2*c* of the infeed conveyor section 2C and are inwardly adjacent the respective sidewalls 21A, 21B. These outer conveyors include so-called guide rail tapes and are movable toward and away from each other by either of the two knobs 22A, 22B. The knobs 22A, 22B can move the guide rails 21A, 21B at a first rate through the medium of transmissions (note the arrow 24 in FIG. 2), and the conveyors 23A, 23B through the medium of take-off devices (note the arrow 25 in FIG. 2) in such a way that the rate of movement of tapes of the outer conveyors 23A, 23B toward and away from each other is different from the rate of movement of the sidewalls 21A, 21B toward and away from each other. The knob 22A or 22B is rotated by hand in order to change the mutual spacing of the sidewalls 21A, 21B and of the outer conveyors 23A, 23B when the format of the stacks 3 is changed. It is presently preferred to select the ratio of movement of the guide rails 21A, 21B and conveyors 23A, 23B in such a way that the extent of movement of conveyors 23A, 23B toward or away from each other equals or approximates two-thirds of the extent of movement of the sidewalls 21A, 21B toward and away from each other. This has been found to ensure that the lateral portions of stacks 3 which advance between the sidewalls 21A, 21B are properly supported from below in the regions between the outer tapes 2*c* and the respective sidewalls.

The transmissions 24 and the take-off devices 25 are shown only symbolically. These parts can constitute a unit which includes suitable links, gears, levers, feed screws, hand wheels and like components enabling an operator to rapidly change the mutual spacing of lead-in conveyors 18A, 18B, sidewalls 21A, 21B and outer conveyors 23A, 23B. For example, the conveyors 18A, 23A and the sidewall 22A can be mounted on a first platform 26A which is movable relative to the support 1, and the conveyors 18B, 23B and the sidewall 21B can be mounted on a second platform 26B which is also movable relative to the support 1. As shown, the knobs 22A, 22B are located at opposite sides of the support 1 so as to ensure that adjustments can be carried out at either side of the support. As mentioned above, the lead-in conveyors 18A, 18*b* are movable toward and away from each other jointly with the respective sidewalls 21A, 21B.

The speed of the tapes 2*b* is less than the speed of the lead-in conveyors 18A, 18B. For example, a prime mover 2*b*' can drive one of the pulleys 2*b*'' for the tapes 2*b* at a speed of 14 inches per cycle.

The improved apparatus further comprises two stop gates 28A, 28B which are disposed downstream of the respective lead-in conveyors 18A, 18B and are movable by suitable mechanisms 29A, 29B to periodically enter the path A in order to engage the adjacent portions of the front end faces 3*d* of successive stacks 3 on their way toward the path portion A1. Such stop gates are in use in existing apparatus for advancing stacks of paper sheets to a wrapping station. A photoelectric detector including a radiation source 30*a* and a transducer 30*b* is provided ahead of the stop gates 28A, 28B in order to transmit signals to the mechanisms 29A, 29B in response to detection of oncoming stacks 3. The gates 28A, 28B can be moved into the path A if the orientation of an oncoming stack 3 is unsatisfactory. Reference may be had to the disclosure in U.S. Pat. No. 4,683,704 to Vorachek et al.

Figure 5:
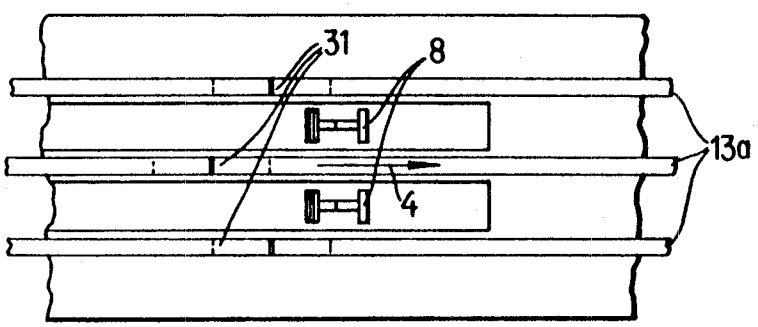
FIG. 5 is a fragmentary side elevational view of the remaining portion of the second conveyor, of a portion of the third conveyor and of a loader finger which ensures proper orientation of stacks on the elevator at the wrapping station.
Figure 7:
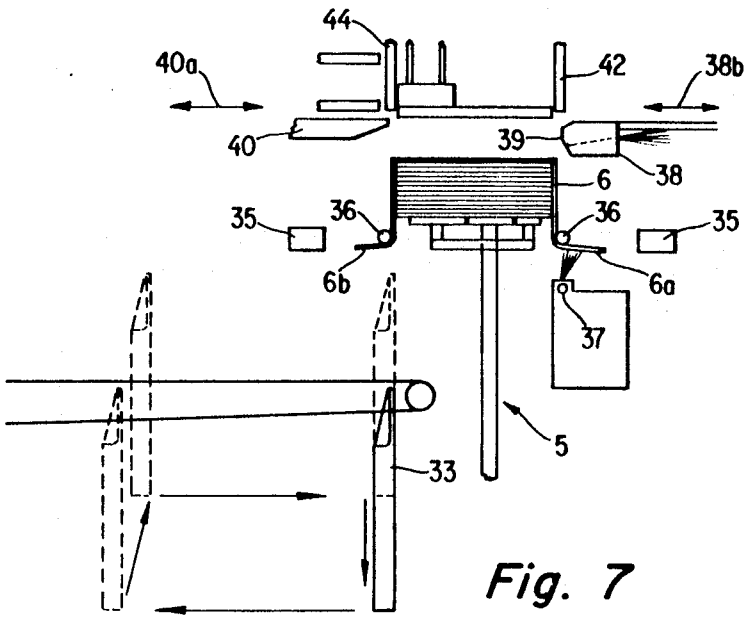
FIG. 7 illustrates the elevator and the stack thereon in an intermediate position, with the blank already draped around the top and around the front and rear end faces of the ascending stack.
Figure 8:
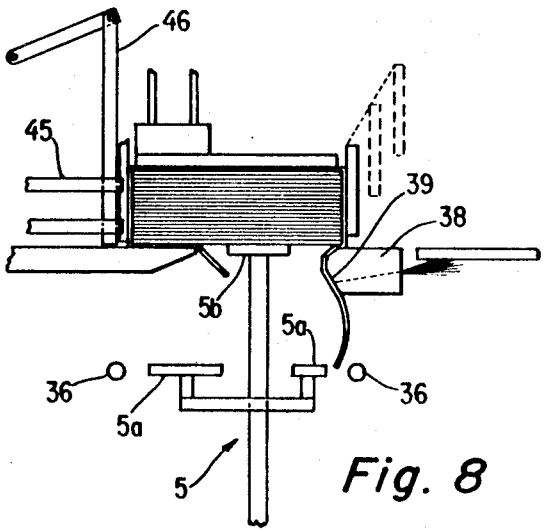
FIG. 8 is a view similar to that of FIG. 7 but showing a further stage of conversion of the blank into a tube which surrounds four sides of the stack.

FIG. 5 shows that the joints 31 between the end portions of tapes 13*a* forming part of the conveyor 13 are offset for smooth transfer of stacks 3 onto the conveyor 13 as well as for equally smooth transfer of stacks from the conveyor 13 onto the elevator 5. The conveyor 13 defines an elongated path C which extends all the way to the elevator 5, i.e., the conveyor 13 can deliver successive stacks 3 directly onto the plates 5*a* of the elevator. Loader fingers 33 (FIGS. 5–7) are provided to move along an endless path 32 and to engage the rear end face 3*c* of a stack 3 on the elevator 5 in order to push the front end face 3*d* of such stack against a stop plate 34. This ensures that each stack 3 which is about to be lifted by the elevator 5 assumes an optimum position with respect to a blank 6 of wrapping material as well as with respect to several instrumentalities which are provided in the wrapper and serve to convert the blank 6 into an envelope completely confining the stack 3. Such confinement (namely conversion of the blank 6 into a tube) begins while the elevator 5 changes the level of the stack 3 by moving it upwardly from the level of FIG. 6 to the level of FIG. 8. The manner in which the loader fingers 33 are moved along its endless path 32 departs from the heretofore known manner in that the loader fingers have a variable stroke. The arrangement is such that the stroke of the loader fingers 33 is shorter for narrower stacks. This renders it possible to reduce the velocity of loading stacks onto the elevator at higher speeds of the stacks. More specifically, the apparatus comprises means for adjusting the return strokes of loader fingers 33.

The blank 6 is attracted to the undersides of two suction chambers 35 which are mounted in the frame of the wrapper and flank two choke bars 36 serving to fold the marginal portions of the blank 6 along the front and rear end faces 3*d*, 3*c* of a stack 3 which rises with the elevator 5. Such lifting of the stack 3 results in folding of the web 6 along the top surface as well as along the front and rear end faces of the stack. The marginal portions 6*a*, 6*b* of the blank 6 extend downwardly beyond the choke bars 36, and the underside of the marginal portion 6*a* is provided with a film of a suitable adhesive which causes the marginal portion 6*a* to adhere to the marginal portion 6*b* when the conversion of the web 6 into a tube is completed.

A front underfolder 38 is movable by an arm 38*a* in directions which are indicted by a double-headed arrow 38*b* and is provided with a built-in vacuum bar 39 serving to attract the marginal portion 6*a* of the blank 6 at a level above the film of adhesive while the underfolder 38 moves in a direction to the left (see FIG. 8) in order to fold the marginal portion 6*a* along the adjacent portion of the underside of the stack 3 on the elevator 5. At the same time, a rear underfolder 40 (which is reciprocable in directions indicated by an arrow 40*a*) is caused to move to the right and to fold the rear marginal portion 6*b* of the blank 6 beneath the adjacent portion of the underside of the stack 3. At such time, the elevator plates 5*a* are spaced apart from the lifted stack 3 so that the latter rests only on the central elevator platform 5*b* and on the underfolders 38, 40. The platform 5*b* is then lowered, the underfolder 40 moves to the right beyond the position of FIG. 8 to ensure that the marginal portion 6*b* is disposed in a horizontal plane, and the underfolder 38 is moved further to the left to cause the marginal portion 6*a* to underlie and to adhere to the marginal portion 6*b*. This completes the conversion of the blank 6 into a tube.

The vacuum bar 39 replaces air bars which are provided in the rear underfolders of conventional wrapping mechanisms.

Figure 6:
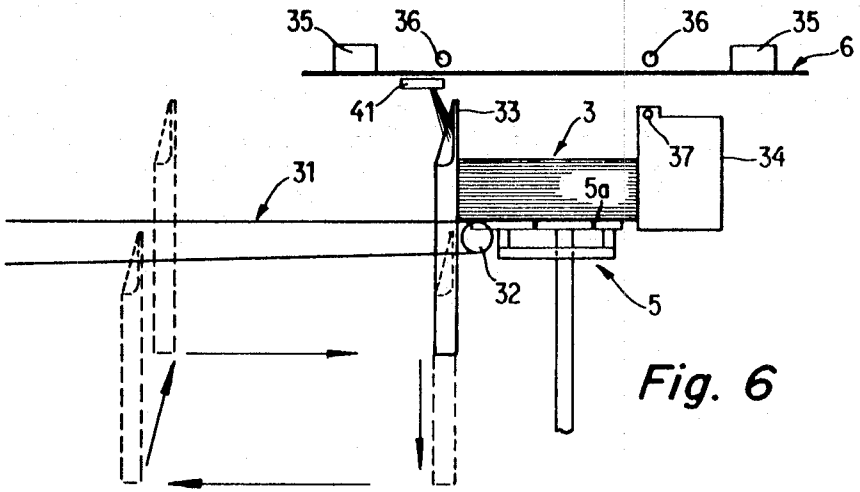
FIG. 6 illustrates the wrapping station with a blank held at a level above a stack on the elevator prior to upward movement of the elevator.

An air bar 41 which is built into a guide for the web 6 serves to discharge jets of air which keep the topmost sheet 3*a* of the stack 3 in place during rapid downward movement of the elevator 5 to the position of FIG. 6. In the absence of the air bar 41, turbulence which is created by the descending elevator 5 could result in shifting of one or more sheets 3*a* on the adjacent stack 3. An air bar 37 of the stop plate 34 discharges one or more jets of air which ensure that the lowermost part of the marginal portion 6*a* is flexed outwardly and can be properly attracted by the vacuum bar 39 of the front underfolder 38 as the elevator 5 continues to lift the stack 3 which rests on the plates 5*a* and platform 5*b*. The purpose of the vacuum bar 39 is to maintain the marginal portion 6*a* away from the elevator 5 and from the rear underfolder 40.

A conventional means for converting the tube (converted blank 6) into a parallelepiped envelope which completely surrounds the stack 3 comprises a front gripper 42, cover plates 43, pusher plates 44, a rear tucker 45 and overhead flights 46 which provide the open ends of the tube with pairs of tucks and thereupon fold the resulting pairs of flaps over each other in a manner not forming part of the present invention. One flap of each pair is provided with a film of adhesive to ensure that the flaps of each pair adhere to each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of supplying stacks of superimposed fully overlapping paper sheets or similar block-shaped commodities to a processing machine, particularly to a wrapping machine, comprising the steps of continuously transporting a series of spaced-apart flights at a first speed along an endless path a portion of which is located in a predetermined plane and wherein the flights continuously advance in a predetermined direction; advancing a series of spaced-apart stacks of superimposed at least nearly fully overlapping sheets at a higher second speed in said predetermined direction along an elongated second path which leads toward the processing machine and a portion of which coincides with said portion of the endless path so that the front sides of successive stacks catch up with successive moving flights and their speed is reduced from the second speed to the first speed to thus align any partially overlapping sheets with the fully overlapping sheets of the respective stacks; disengaging the flights from the respective stacks; moving successive stacks from a first level to a different second level upon disengagement from the respective flights; and draping blanks of wrapping material around successive stacks during movement of stacks between the levels.

2. The method of claim 1, further comprising the step of advancing the stacks along said second path at said first speed prior to moving successive stacks from said first to said second level.

3. The method of claim 1, further comprising the step of changing the orientation of stacks upstream of said portion of said second path when the orientation of stacks deviates from a predetermined orientation in which the front and rear sides of stacks extend at right angles to said direction.

4. Apparatus for supplying stacks of superimposed fully overlapping paper sheets or other block-shaped commodities to a processing machine, particularly to a wrapping machine, comprising an infeed conveyor having means for advancing a series of spaced-apart stacks of superimposed at least nearly fully overlapping sheets in a predetermined direction at a first speed along an elongated first path; a second conveyor defining an endless path including a first portion coinciding with a predetermined portion of said first path and an ascending second portion preceding said first portion; a plurality of spaced-apart flights on said second conveyor; means for continuously driving said second conveyor at a second speed which is less than said first speed so that a stack which advances along said predetermined portion of the first path catches up with and engages a moving flight in said first portion of said second path and is decelerated by the thus engaged moving flight to align any partly overlapping sheets with the fully overlapping sheets of the stack; lead-in conveyors flanking a second portion of said first path upstream of said predetermined portion; sidewalls flanking said predetermined portion of said first path; and means for jointly moving said sidewalls and said lead-in conveyors transversely of said first path.

5. Apparatus for supplying stacks of paper sheets or other block-shaped commodities to a processing machine, particularly to a wrapping machine, comprising an infeed conveyor having means for advancing a series of spaced-apart commodities in a predetermined direction at a first speed along an elongated first path; a second conveyor defining an endless second path including a first portion coinciding with a predetermined portion of said first path and an ascending second portion preceding said first portion; a plurality of spaced-apart flights on said second conveyor; means for driving said second conveyor at a second speed which is less than said first speed so that a commodity which advances along said predetermined portion of the first path catches up with an engages a flight in said first portion of the second path and is decelerated by the thus engaged flight; sidewalls flanking said predetermined portion of said first path; an outer conveyor disposed between each sidewall and said infeed conveyor to support portions of commodities advancing along said predetermined portion of said first path; means for moving said sidewalls towards and away from each other transversely of said first path to thereby select the effective width of the predetermined portion of the first path; and means for moving said outer conveyors toward and away from each other transversely of said first path.

6. The apparatus of claim 5, wherein said infeed conveyor comprises at least two endless tapes which are disposed in two spaced-apart parallel vertical planes and each of said flights includes a portion which is disposed between said planes and extends into said predetermined portion of said first path during movement along said first portion of said second path.

7. The apparatus of claim 5, further comprising an additional conveyor defining a third path which is substantially aligned with and is located downstream of said predetermined portion of said first path, and means for driving said additional conveyor at a speed matching or approximating said second speed.

8. The apparatus of claim 5, further comprising two endless flexible lead-in conveyors flanking a second portion of said first path ahead of the first portion of said second path, each of said lead-in conveyors having a reach adjacent said first path and each such reach including a front section extending in said direction and a rear section sloping forwardly toward said first path so that the second sections of said reaches defining a tapering channel the width of which decreased in said direction to change the orientation of stacks which lie askew during advancement along said first path, and means for driving said lead-in conveyors.

9. The apparatus of claim 5, further comprising means for coupling said moving means for said outer conveyors with said moving means for said sidewalls so that the extent of movement of said outer conveyors relative to each other is less than the extent of movement of said sidewalls relative to each other.

10. Apparatus for supplying stacks of superimposed fully overlapping paper sheets or other block-shaped commodities to a processing machine, particularly to a wrapping machine, comprising an infeed conveyor having means for advancing a series of spaced-apart stacks of superimposed at least nearly fully overlapping sheets in a predetermined direction at a first speed along an elongated first path; a second conveyor defining an endless path including a first portion coinciding with a predetermined portion of said first path and an ascending second portion preceding said first portion; a plurality of spaced-apart flights on said second conveyor; means for continuously driving said second conveyor at a second speed which is less than said first speed so that a stack which advances along said predetermined portion of the first path catches up with and engages a moving flight in said first portion of the second path and is decelerated by the thus engaged moving flight to align any partly overlapping sheets with the fully overlapping sheets of the stack; lead-in conveyors flanking said first path upstream of the first portion of said second path; a stop gate downstream of said lead-in conveyors; and means for moving said stop gate into and from said first path at predetermined intervals.

11. Apparatus for supplying stacks of superimposed fully overlapping paper sheets or other block-shaped commodities to a processing machine, particularly to a wrapping machine, comprising an infeed conveyor having means for advancing a series of spaced-apart stacks of superimposed at least nearly fully overlapping sheets in a predetermined direction at a first speed along an elongated first path; a second conveyor defining an endless path including a first portion coinciding with a predetermined portion of said first path and an ascending second portion preceding said first portion; a plurality of spaced-apart flights on said second conveyor; means for continuously driving said second conveyor at a second speed which is less than said first speed so that a stack which advances along said predetermined portion of the first path catches up with an engages a moving flight in said first portion of the second path and is decelerated by the thus engaged moving flight to align any partly overlapping sheets with the fully overlapping sheets of the stack; a third conveyor defining a third path aligned with and located downstream of said predetermined portion of said first path; means for driving said third conveyor substantially at said second speed; and means for draping successive stacks into successive blanks of wrapping material, said draping means being located downstream of said third path and having an elevator receiving successive stacks directly from said third conveyor.

12. Apparatus for supplying stacks of superimposed fully overlapping paper sheets or other block-shaped commodities to a processing machine, particularly to a wrapping machine, comprising an infeed conveyor having means for advancing a series of spaced-apart stacks of superimposed at least nearly fully overlapping sheets in a predetermined direction at a first speed along an elongated first path; a second conveyor defining an endless path including a first portion coinciding with a predetermined portion of said first path and an ascending second portion preceding said first portion; a plurality of spaced-apart flights on said second conveyor means for continuously driving said second conveyor at a second speed which is less than said first speed so that a stack which advances along said predetermined portion of the first path catches up with an engages a moving flight in said first portion of the second path and is decelerated by the thus engaged moving flight to align any partly overlapping sheets with the fully overlapping sheets of the stack; a third conveyor defining a third path which is substantially aligned with and is located downstream of said predetermined portion of said first path; and means for driving said third conveyor at a speed matching or approximating said second speed, at least one of said infeed and third conveyors including a plurality of endless flexible tapes disposed in spaced-apart parallel planes and said tapes having end portions and joints connecting said end portion to each other, said joints being staggered relative to each other in the longitudinal direction of said tapes.

* * * * *